US008475209B1

(12) United States Patent
Whiteman, Jr. et al.

(10) Patent No.: US 8,475,209 B1
(45) Date of Patent: Jul. 2, 2013

(54) RECEPTACLE ASSEMBLY

(75) Inventors: Robert Neil Whiteman, Jr., Middletown, PA (US); Wayne Samuel Davis, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/396,423

(22) Filed: Feb. 14, 2012

(51) Int. Cl.
*H01R 13/648* (2006.01)

(52) U.S. Cl.
USPC ..... 439/607.07

(58) Field of Classification Search
USPC ..... 439/607.07, 607.06
See application file for complete search history.

(56) References Cited

U.S. PATENT DOCUMENTS

| | | | | |
|---|---|---|---|---|
| 6,409,543 | B1 * | 6/2002 | Astbury et al. | 439/607.07 |
| 6,435,914 | B1 * | 8/2002 | Billman | 439/607.07 |
| 6,712,646 | B2 * | 3/2004 | Shindo | 439/607.07 |
| 6,843,687 | B2 * | 1/2005 | McGowan et al. | 439/607.06 |
| 7,621,779 | B2 * | 11/2009 | Laurx et al. | 439/607.07 |
| 7,682,193 | B2 * | 3/2010 | Stoner | 439/607.07 |
| 7,811,128 | B2 * | 10/2010 | Pan | 439/607.05 |
| 2002/0168898 | A1 * | 11/2002 | Billman et al. | 439/608 |

* cited by examiner

*Primary Examiner* — James Harvey

(57) ABSTRACT

A receptacle assembly includes a front housing having a mating end and a loading end. The front housing has pockets at the loading end separated by separating walls having slots therethrough open at rears thereof. The front housing receives contact modules in corresponding pockets each having a holder holding a plurality of contacts between first and second side walls. The holders have embossments extending from the first side walls proximate to the fronts of the holders. The embossments are loaded into corresponding slots through the rears of the separating walls to control positions of the contact modules with respect to the front housing.

18 Claims, 7 Drawing Sheets

RECEPTACLE ASSEMBLY

BACKGROUND OF THE INVENTION

The subject matter herein relates generally to a connector assembly having contact modules.

Some electrical systems utilize electrical connectors to interconnect two circuit boards, such as a motherboard and daughtercard. Signal loss and/or signal degradation is a problem in known electrical systems. For example, cross talk results from an electromagnetic coupling of the fields surrounding an active conductor or differential pair of conductors and an adjacent conductor or differential pair of conductors. The strength of the coupling generally depends on the separation between the conductors, thus, cross talk may be significant when the electrical connectors are placed in close proximity to each other. Moreover, as speed and performance demands increase, known electrical connectors are proving to be insufficient. Additionally, there is a desire to increase the density of electrical connectors to increase throughput of the electrical system, without an appreciable increase in size of the electrical connectors, and in some cases, with a decrease in size of the electrical connectors. Such increase in density and/or reduction in size causes further strains on performance.

In order to address performance, some electrical connectors have been developed that utilize shielded contact modules that are stacked into a housing. The shielded contact modules have conductive holders that provide shielding around the contacts of the electrical connectors. Due to the large number of contacts of the electrical connectors, loading the contact modules into the housing is difficult. For example, aligning the tips of the contacts with openings through the housing is difficult. Misalignment causes damage to the ends of the contacts. Misalignment may also cause damage to the contacts of the mating electrical connector or may cause the electrical connectors to fail when the contacts cannot be mated.

A need remains for an electrical connector having improved alignment features to help align components thereof during assembly.

BRIEF DESCRIPTION OF THE INVENTION

In one embodiment, a receptacle assembly is provided including a front housing having a mating end and a loading end. The front housing has pockets at the loading end separated by separating walls having slots therethrough open at rears thereof. The front housing receives contact modules in corresponding pockets each having a holder holding a plurality of contacts between first and second side walls. The holders have embossments extending from the first side walls proximate to the fronts of the holders. The embossments are loaded into corresponding slots through the rears of the separating walls to control positions of the contact modules with respect to the front housing.

Optionally, the first side wall may be generally planar and the embossments may extend beyond a plane defined by the first side wall. Each holder may have a plurality of embossments. The rear of each separating wall may be comb-like with fingers positioned between the slots. The front housing may have a top wall and a bottom wall with the separating walls extending vertically between the top and bottom walls. The reception of the embossments in the slots may vertically align the contact modules between the top and bottom walls. The contact modules may be stacked in the front housing such that the embossments of one contact module engage the second side wall of an adjacent contact module.

Optionally, the front housing may include contact channels at the mating end. The mating portions of the contacts may be loaded into corresponding contact channels. The embossments may align the mating portions with the contact channels prior to loading the mating portions into the contact channels. The front housing may have ribs extending into the contact channels. The mating portions may have first and second beams opposing one another across a gap with the rib being positioned in the gap when the mating portions are loaded in the contact channels.

In another embodiment, a receptacle assembly is provided having a front housing having a mating end and a loading end. The mating end is configured for mating with a header assembly. The front housing has contact channels at the mating end and pockets at the loading end separated by separating walls. The separating walls have slots therethrough open at rears of the separating walls. The front housing receives a plurality of contact modules in corresponding pockets through the loading end. The contact modules each have a conductive holder having a first side wall and an opposite second side wall. The holder has a front coupled to the front housing. The holder holds a frame assembly between the first and second side walls. The frame assembly includes a plurality of contacts arranged in pairs and includes at least one dielectric frame supporting the contacts and being held in the holder. The holder provides electrical shielding around the pairs of contacts. The contacts have mating portions extending forward from the front of the holder for loading into corresponding contact channels of the front housing and for electrical termination to the header assembly. The holders have embossments extending from the first side walls proximate to the fronts of the holders. The embossments are loaded into corresponding slots through the rears of the separating walls to align the mating portions of the contacts with the corresponding contact channels during loading of the contact modules into the front housing.

DETAILED DESCRIPTION OF THE INVENTION

Figure 1:
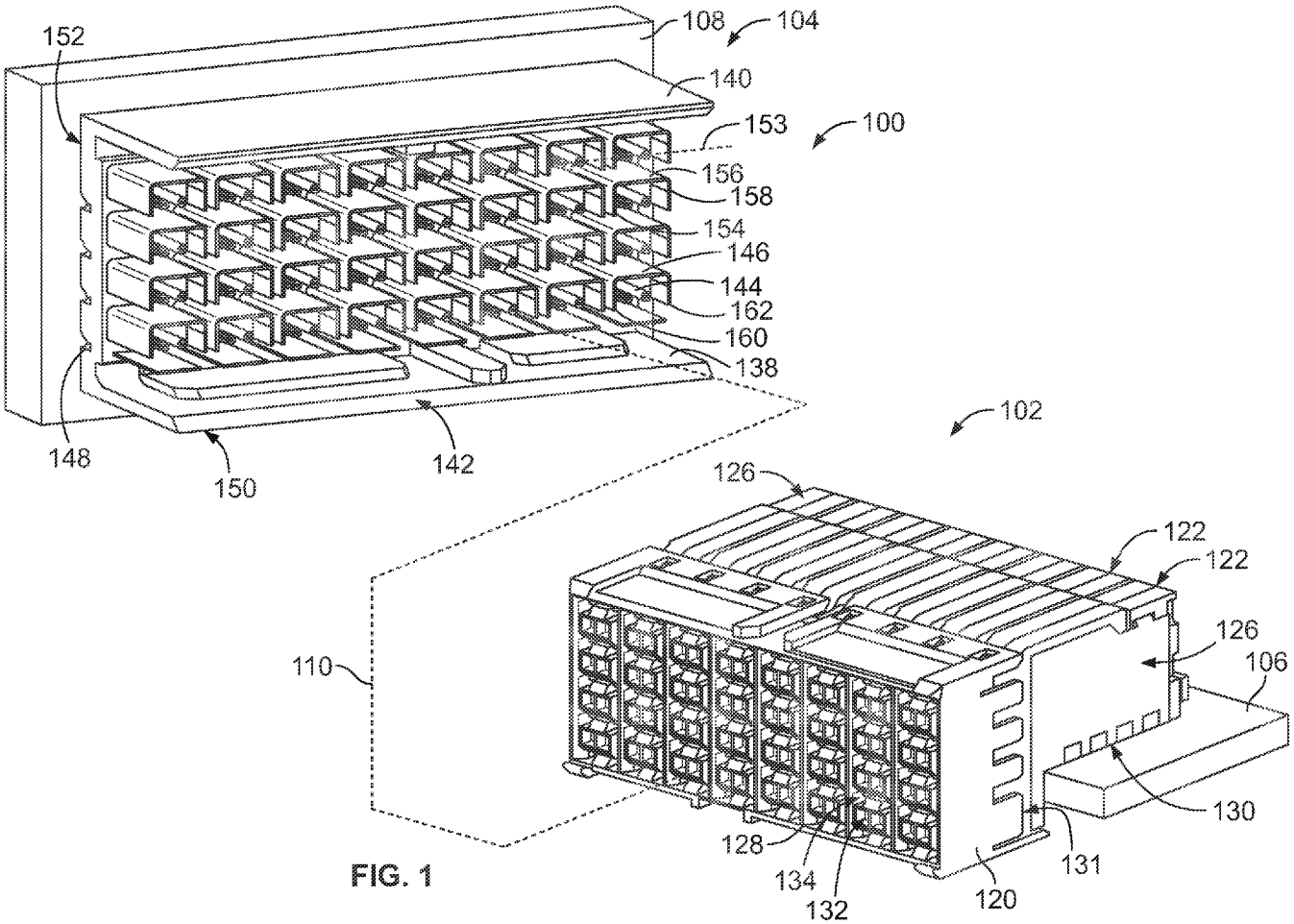
FIG. 1 is a perspective view of an electrical connector system illustrating a receptacle assembly and a header assembly formed in an exemplary embodiment.

FIG. 1 is a perspective view of an exemplary embodiment of an electrical connector system 100 illustrating a receptacle assembly 102 and a header assembly 104 that may be directly mated together. The receptacle assembly 102 and/or the header assembly 104 may be referred to hereinafter individually as a "connector assembly" or collectively as "connector assemblies". The receptacle and header assemblies 102, 104 are each electrically connected to respective circuit boards 106, 108. The receptacle and header assemblies 102, 104 are utilized to electrically connect the circuit boards 106, 108 to one another at a separable mating interface. In an exemplary embodiment, the circuit boards 106, 108 are oriented perpendicular to one another when the receptacle and header assemblies 102, 104 are mated. Alternative orientations of the circuit boards 106, 108 are possible in alternative embodiments.

A mating axis 110 extends through the receptacle and header assemblies 102, 104. The receptacle and header assemblies 102, 104 are mated together in a direction parallel to and along the mating axis 110.

The receptacle assembly 102 includes a front housing 120 that holds a plurality of contact modules 122. Any number of contact modules 122 may be provided to increase the density of the receptacle assembly 102. The contact modules 122 each include a plurality of receptacle signal contacts 124 (shown in FIG. 3) that are received in the front housing 120 for mating with the header assembly 104. In an exemplary embodiment, each contact module 122 has a shield structure 126 for providing electrical shielding for the receptacle signal contacts 124. In an exemplary embodiment, the shield structure 126 is electrically connected to the circuit board 106, and may be electrically connected to the header assembly 104 when the receptacle and header assemblies 102, 104 are mated. For example, the shield structure 126 may be electrically connected to the header assembly 104 by extensions (e.g. beams or fingers) extending from the contact modules 122 that engage the header assembly 104. The shield structure 126 may be electrically connected to the circuit board 106 by features, such as ground pins.

The receptacle assembly 102 includes a mating end 128 and a mounting end 130. The receptacle signal contacts 124 are received in the front housing 120 and held therein at the mating end 128 for mating to the header assembly 104. The receptacle signal contacts 124 are arranged in a matrix of rows and columns. In the illustrated embodiment, at the mating end 128, the rows are oriented horizontally and the columns are oriented vertically. Other orientations are possible in alternative embodiments. Any number of receptacle signal contacts 124 may be provided in the rows and columns. The receptacle signal contacts 124 also extend to the mounting end 130 for mounting to the circuit board 106. Optionally, the mounting end 130 may be substantially perpendicular to the mating end 128.

The front housing 120 defines the mating end 128 of the receptacle assembly 102. The front housing 120 also includes a loading end 131 at a rear of the front housing 120. The contact modules 122 are loaded into the front housing 120 through the loading end 131. In the illustrated embodiment, the contact modules 122 extend beyond (e.g. rearward from) the loading end 131.

The front housing 120 includes a plurality of signal contact openings 132 and a plurality of ground contact openings 134 at the mating end 128. The receptacle signal contacts 124 are received in corresponding signal contact openings 132. Optionally, a single receptacle signal contact 124 is received in each signal contact opening 132. The signal contact openings 132 may also receive corresponding header signal contacts 144 therein when the receptacle and header assemblies 102, 104 are mated. The ground contact openings 134 receive header shields 146 therein when the receptacle and header assemblies 102, 104 are mated. The ground contact openings 134 receive grounding beams 302 (shown in FIG. 3) of the header shields 126 that mate with the header shields 146 to electrically common the receptacle and header assemblies 102, 104.

The front housing 120 is manufactured from a dielectric material, such as a plastic material, and provides isolation between the signal contact openings 132 and the ground contact openings 134. The front housing 120 isolates the receptacle signal contacts 124 and the header signal contacts 144 from the header shields 146. The front housing 120 isolates each set of receptacle and header signal contacts 124, 144 from other sets of receptacle and header signal contacts 124, 144.

The header assembly 104 includes a header housing 138 having walls 140 defining a chamber 142. The header assembly 104 has a mating end 150 and a mounting end 152 that is mounted to the circuit board 108. Optionally, the mounting end 152 may be substantially parallel to the mating end 150. The receptacle assembly 102 is received in the chamber 142 through the mating end 150. The front housing 120 engages the walls 140 to hold the receptacle assembly 102 in the chamber 142. The header signal contacts 144 and the header shields 146 extend from a base wall 148 into the chamber 142. The header signal contacts 144 and the header shields 146 extend through the base wall 148 and are mounted to the circuit board 108.

In an exemplary embodiment, the header signal contacts 144 are arranged as differential pairs. The header signal contacts 144 are arranged in rows along row axes 153. The header shields 146 are positioned between the differential pairs to provide electrical shielding between adjacent differential pairs. In the illustrated embodiment, the header shields 146 are C-shaped and provide shielding on three sides of the pair of header signal contacts 144. The header shields 146 have a plurality of walls, such as three planar walls 154, 156, 158. The walls 154, 156, 158 may be integrally formed or alternatively, may be separate pieces. The wall 156 defines a center wall or top wall of the header shields 146. The walls 154, 158 define side walls that extend from the center wall 156. The walls 154, 156, 158 have interior surfaces that face the header signal contacts 144 and exterior surfaces that face away from the header signal contacts 144.

The header shields 146 have edges 160, 162 at opposite ends of the header shields 146. The edges 160, 162 are downward facing. The edges 160, 162 are provided at the distal ends of the walls 154, 158, respectively. The bottom is open between the edges 160, 162. The header shield 146 associated with another pair of header signal contacts 144 provides the shielding along the open, fourth side thereof such that each of the pairs of signal contacts 144 is shielded from each adjacent pair in the same column and the same row. For example, the top wall 156 of a first header shield 146 which is below a second header shield 146 provides shielding across the open bottom of the C-shaped second header shield 146. Other configurations or shapes for the header shields 146 are possible in alternative embodiments. More or less walls may be provided in alternative embodiments. The walls may be bent or angled rather than being planar. In other alternative embodiments, the header shields 146 may provide shielding for individual signal contacts 144 or sets of contacts having more than two signal contacts 144.

Figure 2:
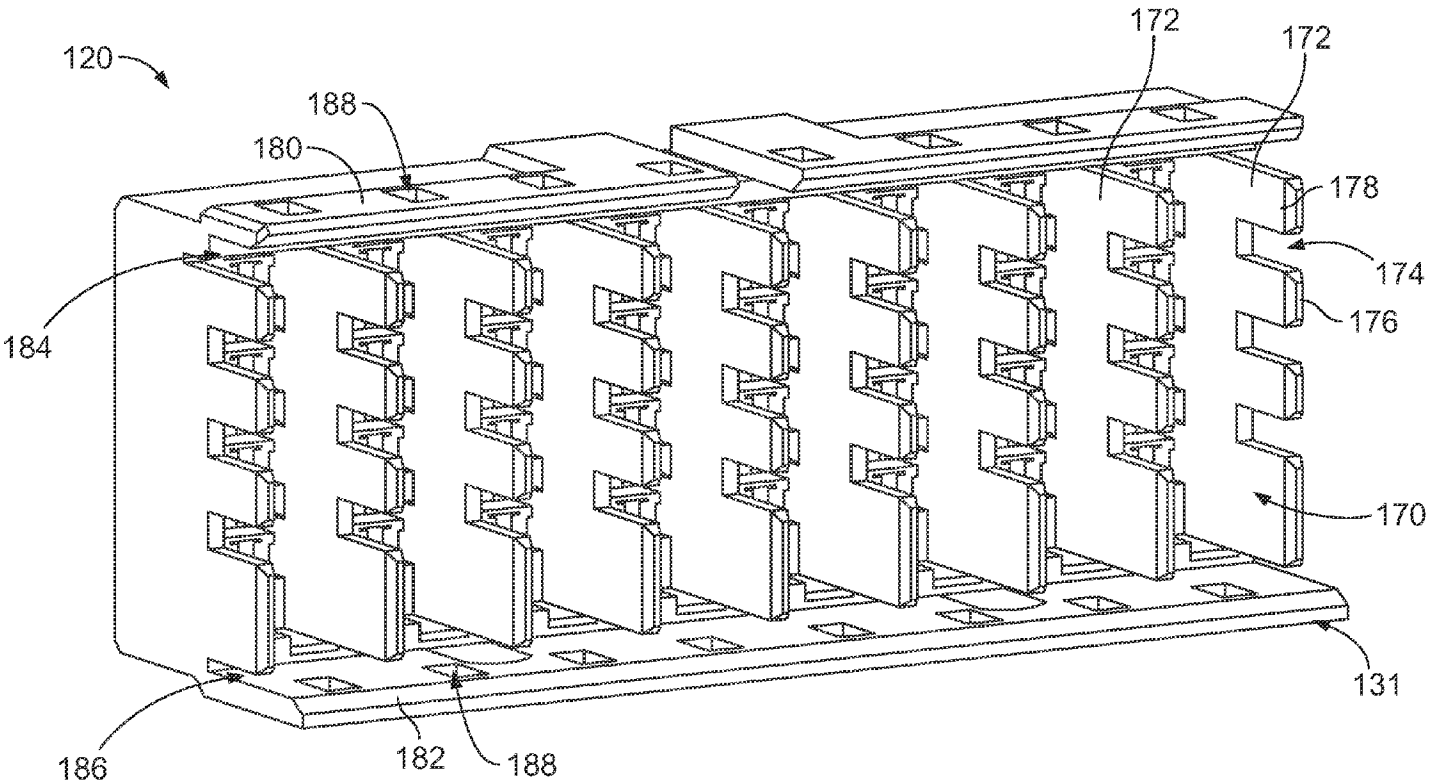
FIG. 2 is a rear perspective view of a front housing of the receptacle assembly shown in FIG. 1.

FIG. 2 is a rear perspective view of the front housing 120 of the receptacle assembly 102. The front housing 120 includes pockets 170 at the loading end 131. The pockets 170 are separated by separating walls 172. The pockets 170 receive corresponding contact modules 122 (shown in FIG. 1). The separating walls 172 engage the contact modules 122 to hold the contact modules 122 in position with respect to one another. In the illustrated embodiment, the separating walls 172 are oriented vertically. Other orientations are possible in alternative embodiments. The separating walls 172 may be generally planar.

The separating walls 172 have slots 174 therethrough open at rears 176 of the separating walls 172. The slots 174 receive portions of the contact modules 122 to position the contact modules 122 in the pockets 170. For example, the slots 174 may vertically position the contact modules 122 in the pockets 170. At the rear 176, the separating walls 172 are comb-like and include fingers 178 between slots 174.

The front housing 120 includes a top wall 180 and a bottom wall 182. The separating walls 172 extend at least partially between the top and bottom walls 180, 182. In an exemplary embodiment, the top and bottom walls 180, 182 are separated from the separating walls 172 at the rears 176 thereof such that gaps 184, 186 exist therebetween. The top and bottom walls 180, 182 may be flexed or deflected outward away from the separating walls 172, such as during loading of the contact modules 122 into the front housing 120. The top and bottom walls 180, 182 include openings 188 that receive latches or other securing features on the contact modules 122 to hold the contact modules 122 in the front housing 120.

Figure 3:
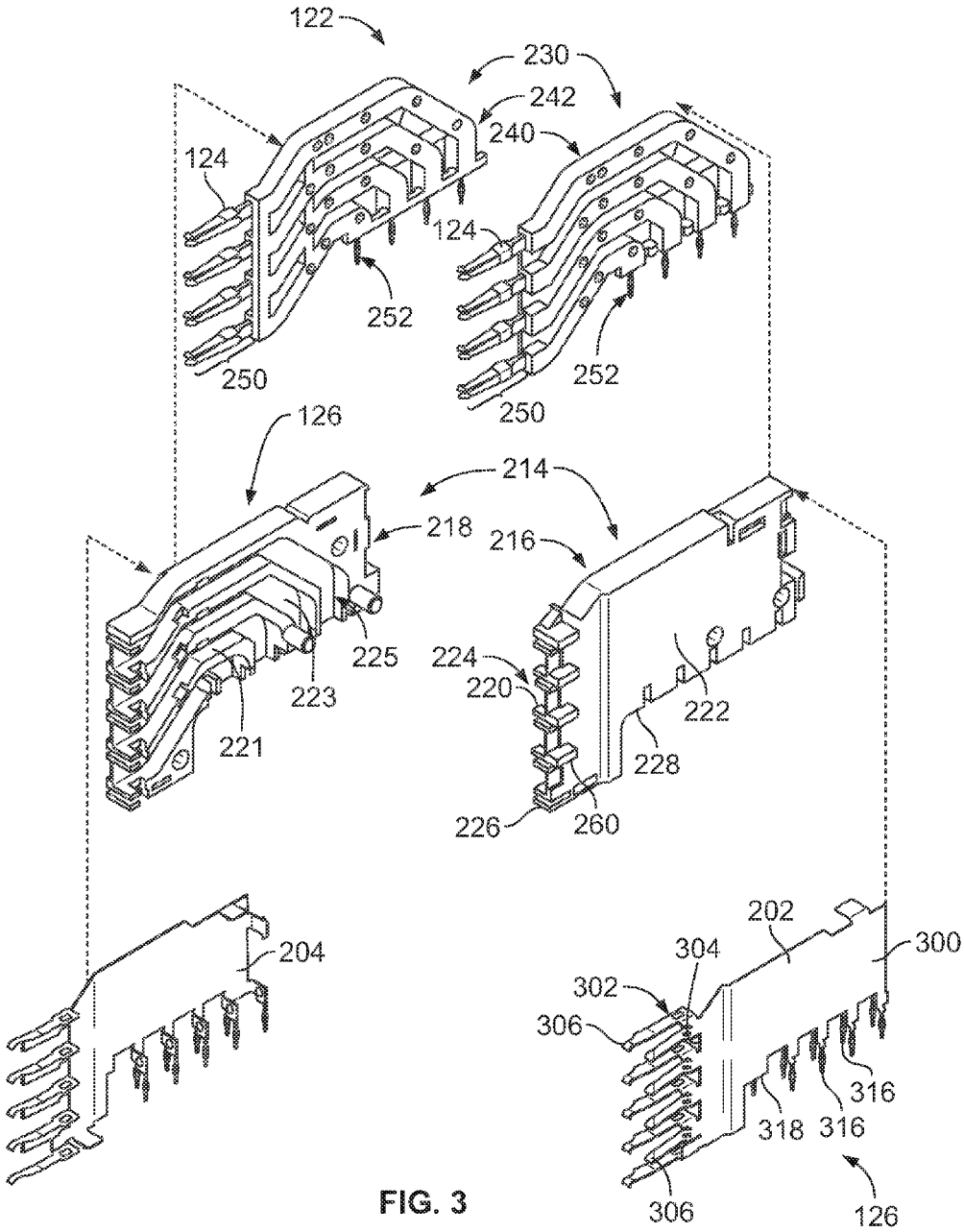
FIG. 3 is an exploded view of a contact module for the receptacle assembly shown in FIG. 1.

FIG. 3 is an exploded view of one of the contact modules 122 and part of the shield structure 126. The shield structure 126 includes a first ground shield 202 and a second ground shield 204. The first and the second ground shields 202, 204 electrically connect the contact module 122 to the header shields 146 (shown in FIG. 1). The first and the second ground shields 202, 204 provide multiple, redundant points of contact to the header shield 146. For example, the first and the second ground shields may be configured to define at least two points of contact with each C-shaped header shield 146 (shown in FIG. 1). The first and the second ground shields 202, 204 provide shielding on all sides of the receptacle signal contacts 124.

The contact module 122 includes a holder 214 having a first holder member 216 and a second holder member 218 that are coupled together to form the holder 214. In an exemplary embodiment, the holder members 216, 218 are fabricated from a conductive material. For example, the holder members 216, 218 may be die-cast from a metal material. Alternatively, the holder members 216, 218 may be stamped and formed or may be fabricated from a plastic material that has been metalized or coated with a metallic layer. By having the holder members 216, 218 fabricated from a conductive material, the holder members 216, 218 may provide electrical shielding for the receptacle assembly 102. When the holder members 216, 218 are coupled together, the holder members 216, 218 define at least a portion of the shield structure 126 of the receptacle assembly 102. The first and second ground shields 202, 204 are mechanically and electrically coupled to the holder members 216, 218, respectively, to couple the ground shields 202, 204 to the holder 214. The holder members 216, 218 include tabs 220, 221 extending inward from first and second side walls 222, 223 thereof. The tabs 220 define channels 224 therebetween. The tabs 221 define channels 225 similar to the channels 224. The tabs 220, 221 define at least a portion of the shield structure 126 of the receptacle assembly 102. When assembled, the holder members 216, 218 are coupled together and define a front 226 and a bottom 228 of the holder 214.

The contact module 122 includes a frame assembly 230 held by the holder 214. The frame assembly 230 includes the receptacle signal contacts 124. In an exemplary embodiment, the frame assembly 230 includes a pair of dielectric frames 240, 242 surrounding the receptacle signal contacts 124. The receptacle signal contacts 124 may be initially held together as lead frames (not shown), which are overmolded with dielectric material to form the dielectric frames 240, 242. Other manufacturing processes may be utilized to form the contact modules 122, such as loading receptacle signal contacts 124 into a formed dielectric body.

The receptacle signal contacts 124 have mating portions 250 extending from a front wall and contact tails 252 extending from a bottom wall of the corresponding dielectric frame 240, 242. Other configurations are possible in alternative embodiments. In an exemplary embodiment, the mating portions 250 extend generally perpendicular with respect to the contact tails 252. Alternatively, the mating portions 250 and the contact tails 252 may be at any angle to each other. Inner portions or encased portions of the receptacle signal contacts 124 transition between the mating portions 250 and the contact tails 252 within the dielectric frames 240, 242. The tabs 220, 221 extend through the dielectric frames 240, 242 between corresponding receptacle signal contacts 124 to provide shielding between corresponding receptacle signal contacts 124.

The holder members 216, 218, which are part of the shield structure 126, provide electrical shielding between and around respective receptacle signal contacts 124. The holder members 216, 218 provide shielding from electromagnetic interference (EMI) and/or radio frequency interference (RFI). The holder members 216, 218 may provide shielding from other types of interference as well. The holder members 216, 218 provide shielding around the outside of the dielectric frames 240, 242 and thus around the outside of all of the receptacle signal contacts 124, such as between pairs of receptacle signal contacts 124, as well as between the receptacle signal contacts 124 using the tabs 220, 221 to control electrical characteristics, such as impedance control, cross-talk control, and the like, of the receptacle signal contacts 124.

The holder 214 includes embossments 260 extending from the first side wall 222. The embossments 260 extend outward beyond the plane defined by the first side wall 222. The embossments 260 are positioned proximate to the front 226. The embossments 260 may have any shape. In the illustrated embodiment, the embossments 260 have a rectangular shape. The embossments 260 may each have the same shape and size. Alternatively, one or more of the embossments 260 may have different sizes and/or shapes, such as to define keying or orientation features. The embossments 260 are sized and shaped to fit in corresponding slots 174 (shown in FIG. 2) of the front housing 120 (shown in FIG. 2). In an exemplary embodiment, the embossments 260 fill the corresponding slots 174.

The first and second ground shields 202, 204 are similar to one another, and only the first ground shield 202 is described in detail herein, but the second ground shield 204 includes similar features. The first ground shield 202 includes a main body 300. In the illustrated embodiment, the main body 300 is generally planar.

The first ground shield 202 includes grounding beams 302 extending forward from a front 304 of the main body 300. The grounding beams 302 extend forward from the front 226 of the holder 214 such that the grounding beams 302 may be loaded into the front housing 120 (shown in FIG. 1). Each grounding beam 302 has a mating interface 306 at a distal end thereof. The mating interface 306 is configured to engage the corresponding header shield 146.

The first ground shield 202 includes a plurality of ground pins 316 extending from a bottom 318 of the first ground shield 202. The ground pins 316 are configured to be terminated to the circuit board 106 (shown in FIG. 1). The ground pins 316 may be compliant pins, such as eye-of-the-needle pins, that are throughhole mounted to plated vias in the circuit board 106. Other types of termination means or features may be provided in alternative embodiments to couple the first ground shield 202 to the circuit board 106.

Figure 4:
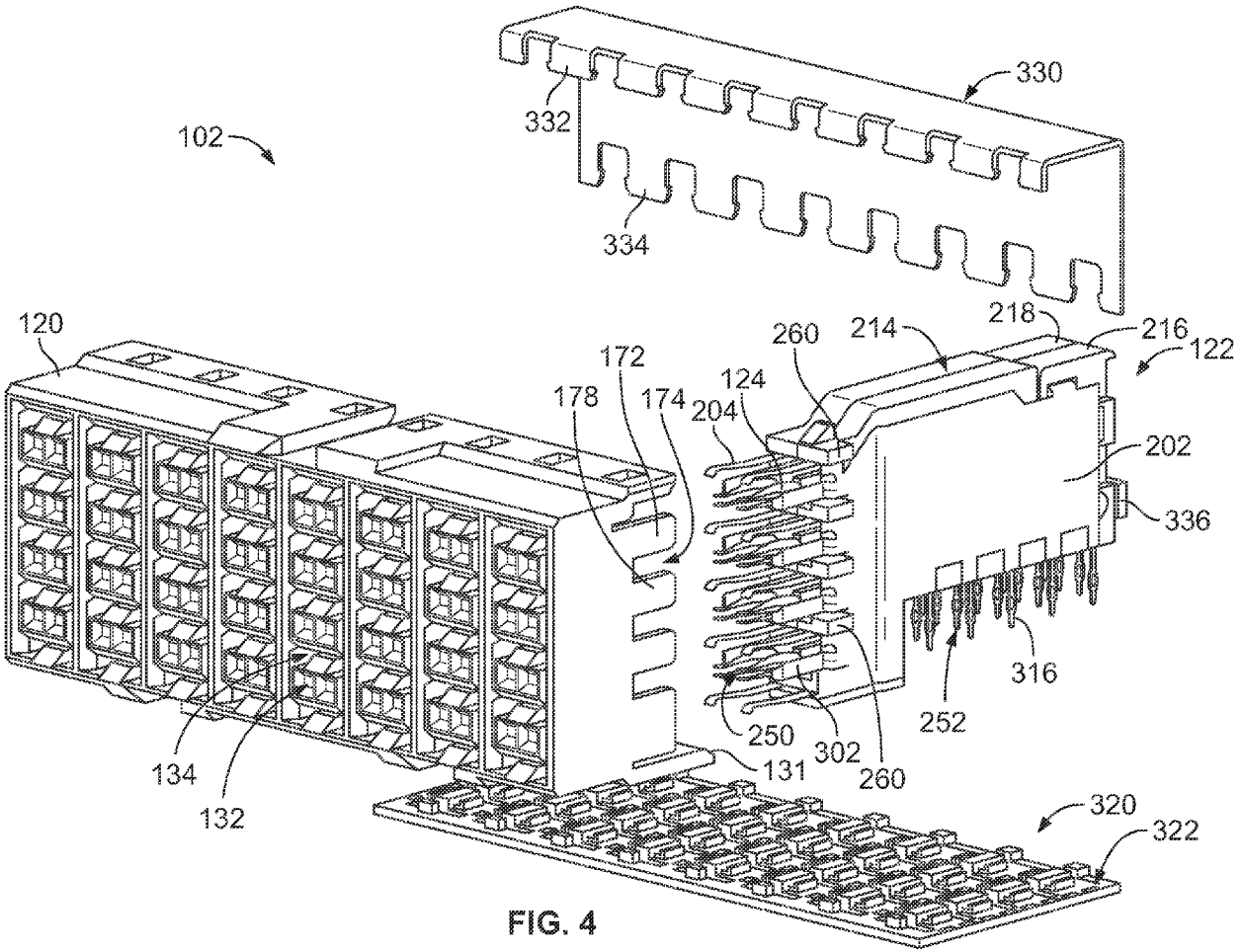
FIG. 4 is an exploded perspective view of the receptacle assembly showing one of the contact modules in an assembled state poised for loading into the front housing.

FIG. 4 is an exploded perspective view of the receptacle assembly 102 showing one of the contact modules 122 in an assembled state poised for loading into the front housing 120. During assembly, the dielectric frames 240, 242 (shown in FIG. 3) are received in the corresponding holder members 216, 218. The holder members 216, 218 are coupled together and generally surround the dielectric frames 240, 242. The dielectric frames 240, 242 are aligned adjacent one another such that the receptacle signal contacts 124 are aligned with one another and define contact pairs. Each contact pair is configured to transmit differential signals through the contact module 122. The receptacle signal contacts 124 within each contact pair are arranged in rows that extend along row axes. The receptacle signal contacts 124 within the dielectric frame 240 are arranged within a column along a column axis. Similarly, the receptacle signal contacts 124 of the dielectric frame 242 are arranged in a column along a column axis.

The first and the second ground shields 202, 204 are coupled to the holder 214 to provide shielding for the receptacle signal contacts 124. When assembled, the ground shields 202, 204 are positioned on the exterior sides of the conductive holder 214. The embossments 260 extend beyond the ground shield 202. The grounding beams 302 provide shielding around the contact pairs. The grounding beams 302 are configured to electrically connect to the header shields 146 (shown in FIG. 1) when the receptacle assembly 102 is coupled to the header assembly 104 (shown in FIG. 1).

During assembly, the contact module 122 is aligned with the front housing 120. The embossments 260 are aligned with the slots 174 in the separating walls 172. As the contact module 122 is loaded into the front housing 120 through the loading end 131, the embossments 260 are received in corresponding slots 174. The fingers 178 are positioned between the embossments 260. The embossments 260 and slots 174 vertically align the contact module 122 with respect to the front housing 120. Having the contact modules 122 aligned with the front housing 120 aligns the mating portions 250 of the receptacle signal contacts 124 with the signal contact openings 132. Having the contact modules 122 aligned with the front housing 120 aligns the grounding beams 302 with the ground contact openings 134.

In an exemplary embodiment, the receptacle assembly 102 includes a spacer 320. The spacer 320 is configured to be coupled to each of the contact modules 122. The spacer 320 includes openings 322 that receive the contact tails 252 and the ground pins 316. The spacer 320 holds the true positions of the contact tails 252 and the ground pins 316 for mounting to the circuit board 106 (shown in FIG. 1).

In an exemplary embodiment, the receptacle assembly 102 includes an organizer clip 330. The organizer clip 330 is configured to be coupled to each of the contact modules 122. The organizer clip 330 includes tabs 332 that extend into the tops of the contact modules 122 to hold the positions of the contact modules relative to each other. The organizer clip 330 includes tabs 334 that engage posts 336 that extend from the rears of the contact modules 122 to hold the positions of the contact modules relative to each other.

Figure 5:
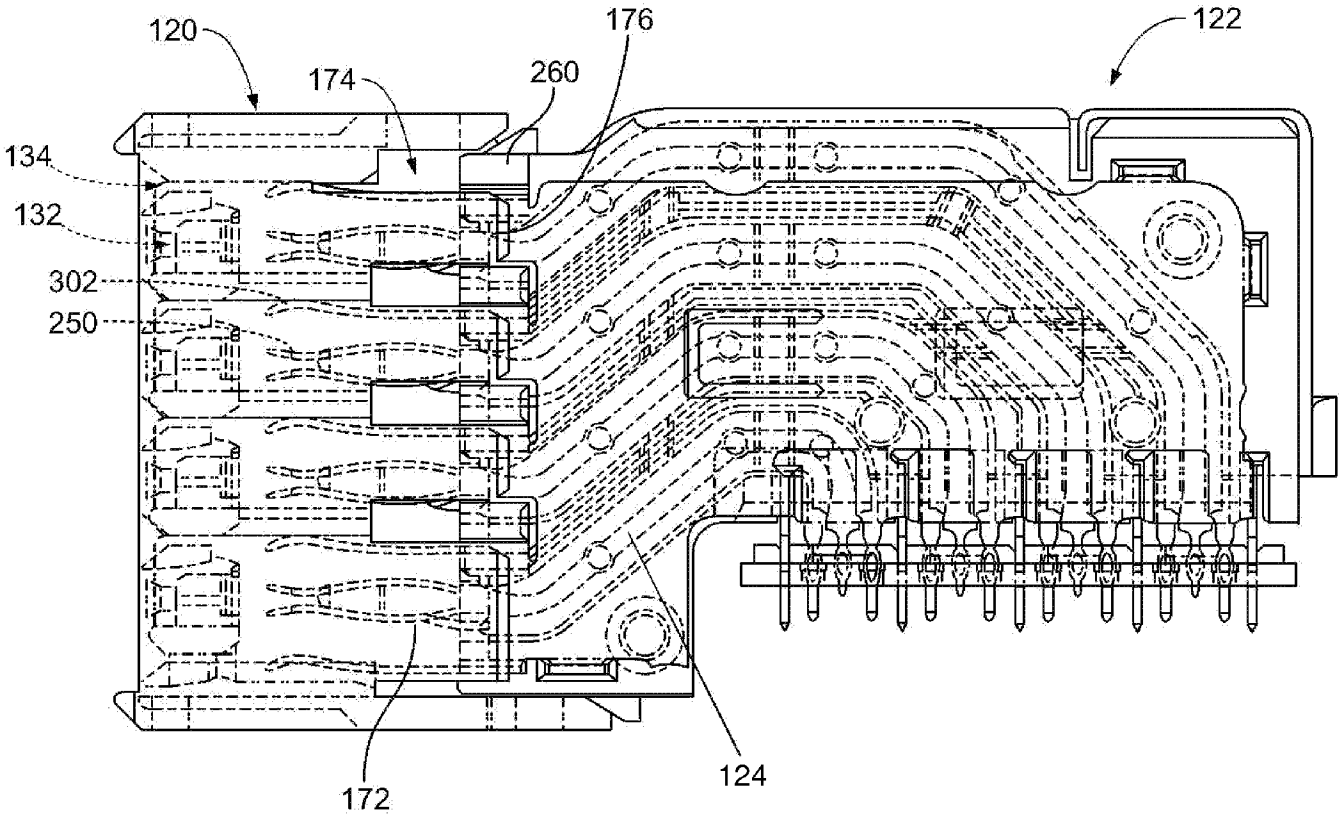
FIG. 5 is a side view of one of the contact modules being loaded into the front housing.

FIG. 5 is a side view of one of the contact modules 122 being loaded into the front housing 120. The embossments 260 are received in the slots 174. The slots 174 are chamfered at the rear 176 of the separating wall 172 to guide the embossments 260 into the slots 174. The embossments 260 vertically align the contact module 122. Having the contact module 122 aligned with the front housing 120 aligns the mating portions 250 (shown in phantom) of the receptacle signal contacts 124 (shown in phantom) with the signal contact openings 132 (shown in phantom) and aligns the grounding beams 302 (shown in phantom) with the ground contact openings 134 (shown in phantom). In an exemplary embodiment, the embossments 260 are received in the slots 174 prior to the tips of the receptacle signal contacts 124 or the grounding beams 302 being received in the signal or ground contact openings 132, 134 to prevent stubbing or damage to the receptacle signal contacts 124 or the grounding beams 302. the embossments 260 are received in the slots 174 prior to the openings 188 (shown in FIG. 2) receiving latches or other securing features of the contact modules 122.

Figure 6:
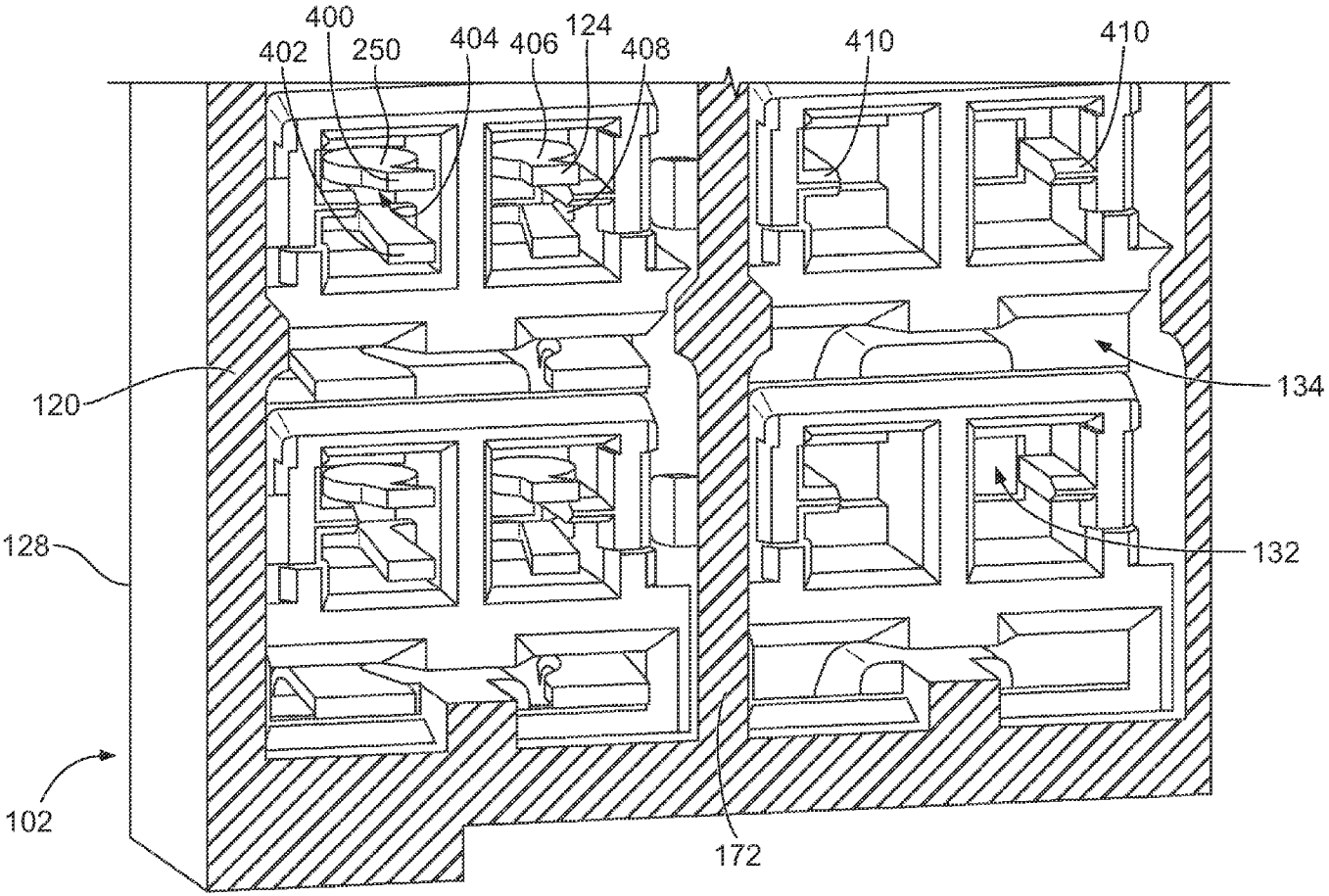
FIG. 6 is a rear perspective, partial sectional view of the receptacle assembly showing one of the contact modules loaded into the front housing.

FIG. 6 is a rear perspective, partial sectional view of the receptacle assembly 102 showing one of the contact modules 122 (shown in FIG. 1) loaded into the front housing 120. The front housing 120 is sectioned close to the mating end 128, through the separating walls 172 just rearward of the signal and ground contact openings 132, 134.

In an exemplary embodiment, the mating portions 250 of the receptacle signal contacts 124 each have first and second beams 400, 402 opposing one another across a gap 404. The header signal contact 144 (shown in FIG. 1) is configured to be received in the gap 404 such that the beams 400, 402 engage opposite sides of the header signal contact 144. In an exemplary embodiment, the beams have paddles 406, 408, respectively, at the tips thereof. The paddles 406, 408 are wider than other portions of the beams 400, 402. The paddles 406, 408 are angled away from each other to widen the gap 404 at the front of the receptacle signal contact 124. The beams 400, 402 are received in the signal contact openings 132. To prevent stubbing of the beams 400, 402 on the front housing 120 during loading of the contact module 122 into the front housing 120, the embossments 260 (shown in FIG. 5) vertically align the beams 400, 402 with the corresponding signal contact opening 132.

In an exemplary embodiment, the front housing 120 includes ribs 410 that extend into the signal contact openings 132. The ribs 410 may be integrally formed with the front housing 120. For proper mating with the header signal contacts 144, the beams 400, 402 need to straddle the corresponding rib 410 with the beam 400 positioned above the rib 410 and the beam 402 positioned below the rib 410. The paddles 406, 408 may engage the rib 410 to position the beams 400, 402 within the signal contact openings 132. In an exemplary embodiment, the rib 410 holds the beams 400, 402 away from each other such that the gap 404 exists and maintains a minimum width. Ensuring that the gap 404 remains open prevents stubbing when the header signal contact 144 is loaded into the signal contact opening 132 during mating with the receptacle signal contact 124.

Figure 7:
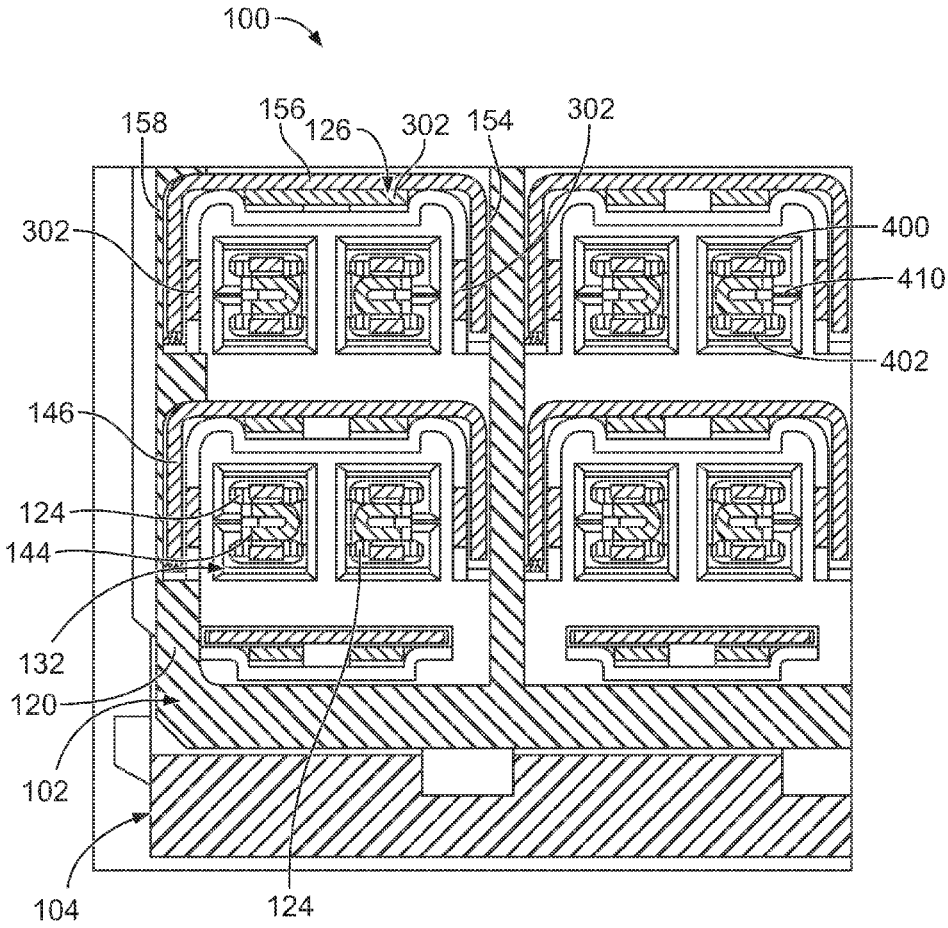
FIG. 7 is a partial sectional view of the electrical connector system showing the receptacle assembly mated to the header assembly.

FIG. 7 is a partial sectional view of the electrical connector system 100 showing the receptacle assembly 102 mated to the header assembly 104. When mated, the header signal contacts 144 are loaded into the signal contact openings 132 to mate with the receptacle signal contacts 124. The beams 400, 402 are positioned above and below, respectively, the ribs 410.

When mated, the header shields 146 extend into the front housing 120 to engage the grounding beams 302. The grounding beams 302 engage interior surfaces of the walls 154, 156, 158 of the C-shaped header shields 146 to make electrical connection therewith. By engaging the interior surfaces of the side walls 154, 158, the grounding beams 302 are forced inward, which pull the ground shields 202, 204 (shown in FIG. 3) inward. Such action tends to force the ground shields

202, 204 against, and into electrical contact with, the conductive holder 214 (shown in FIG. 3). Such action tends to compress the holder members 216, 218 (shown in FIG. 3) together.

In an exemplary embodiment, the grounding beams 302 are deflectable and are configured to be spring biased against the header shields 146 to ensure electrical connection with the header shields 146. In an exemplary embodiment, the header shields 146 and the shield structure 126 provide peripheral shielding for the receptacle signal contacts 124. For example, the side walls 154, 158 and the side grounding beams 302 provide shielding along the sides of the receptacle signal contacts 124 between the columns of the receptacle signal contacts 124, such as between receptacle signal contacts 124 held within different contact modules 122. The upper grounding beams 302 and the top walls 156 extend above receptacle signal contacts 124 to provide shielding between receptacle signal contacts 124 in different rows.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A receptacle assembly comprising:

a front housing having a mating end and a loading end, the mating end being configured for mating with a header assembly, the front housing having pockets at the loading end separated by separating walls, the separating walls having slots therethrough open at rears of the separating walls, the front housing receiving a plurality of contact modules in corresponding pockets through the loading end;

the contact modules each comprising a holder having a first side wall and an opposite second side wall, the holder having a front coupled to the front housing, the holder holding a plurality of contacts between the first and second side walls, the contacts having mating portions extending forward from the front of the holder for electrical termination to the header assembly;

wherein the holders comprise embossments extending from the first side walls proximate to the fronts of the holders, the embossments loaded into corresponding slots through the rears of the separating walls to control positions of the contact modules with respect to the front housing.

2. The receptacle assembly of claim 1, wherein the first side wall is generally planar, the embossments extending beyond a plane defined by the first side wall.

3. The receptacle assembly of claim 1, wherein each holder comprises a plurality of embossments.

4. The receptacle assembly of claim 1, wherein the rear of each separating wall is comb-like with fingers positioned between the slots, the fingers being positioned between the embossments.

5. The receptacle assembly of claim 1, further comprising a ground shield coupled to the first side wall, the embossments extending beyond the ground shield.

6. The receptacle assembly of claim 1, wherein the front housing includes a top wall and a bottom wall, the separating walls extending vertically between the top and bottom walls, the reception of the embossments in the slots vertically aligns the contact modules between the top and bottom walls.

7. The receptacle assembly of claim 1, wherein the front housing includes contact openings at the mating end, the mating portions being loaded into corresponding contact openings, the embossments aligning the mating portions with the contact openings prior to loading the mating portions into the contact openings.

8. The receptacle assembly of claim 7, further comprising ribs extending into the contact openings, each mating portion having first and second beams opposing one another across a gap, the ribs being positioned in the gaps when the mating portions are loaded in the contact openings.

9. The receptacle assembly of claim 1, wherein the contact modules are stacked in the front housing such that the embossments of one contact module engage the second side wall of an adjacent contact module.

10. A receptacle assembly comprising:

a front housing having a mating end and a loading end, the mating end being configured for mating with a header assembly, the front housing having contact openings at the mating end, the front housing having pockets at the loading end separated by separating walls, the separating walls having slots therethrough open at rears of the separating walls, the front housing receiving a plurality of contact modules in corresponding pockets through the loading end;

the contact modules each comprising a conductive holder having a first side wall and an opposite second side wall, the holder having a front coupled to the front housing, the holder holding a frame assembly between the first and second side walls, the frame assembly comprising a plurality of contacts arranged in pairs, the frame assembly having at least one dielectric frame supporting the contacts and being held in the holder, the holder providing electrical shielding around the pairs of contacts, the contacts having mating portions extending forward from the front of the holder for loading into corresponding contact openings of the front housing and for electrical termination to the header assembly;

wherein the holders comprise embossments extending from the first side walls proximate to the fronts of the holders, the embossments loaded into corresponding slots through the rears of the separating walls to align the mating portions of the contacts with the corresponding contact openings during loading of the contact modules into the front housing.

11. The receptacle assembly of claim 10, wherein the first side wall is generally planar, the embossments extending beyond a plane defined by the first side wall.

12. The receptacle assembly of claim 10, wherein each holder comprises a plurality of embossments.

13. The receptacle assembly of claim 10, wherein the rear of each separating wall is comb-like with fingers positioned between the slots, the fingers being positioned between the embossments.

14. The receptacle assembly of claim 10, further comprising a ground shield coupled to the first side wall, the embossments extending beyond the ground shield.

15. The receptacle assembly of claim 10, wherein the front housing includes a top wall and a bottom wall, the separating walls extending vertically between the top and bottom walls, the reception of the embossments in the slots vertically aligns the contact modules between the top and bottom walls.

16. The receptacle assembly of claim 10, wherein the embossments align the mating portions with the contact openings prior to loading the mating portions into the contact openings.

17. The receptacle assembly of claim 10, further comprising ribs extending into the contact openings, each mating portion having first and second beams opposing one another across a gap, the ribs being positioned in the gaps when the mating portions are loaded in the contact openings.

18. The receptacle assembly of claim 10, wherein the contact modules are stacked in the front housing such that the embossments of one contact module engage the second side wall of an adjacent contact module.

* * * * *